US010600386B2

(12) United States Patent
Liu

(10) Patent No.: US 10,600,386 B2
(45) Date of Patent: Mar. 24, 2020

(54) IMAGE ADJUSTING METHOD OF IMPROVING DETAILS OF A BRIGHT SCENE AND A DARK SCENE WITHIN AN IMAGE FRAME AND RELATED DISPLAY APPARATUS

(71) Applicant: BENQ CORPORATION, Taipei (TW)

(72) Inventor: Hsiu-Fang Liu, Taipei (TW)

(73) Assignee: BenQ Corporation, Taipei (TW)

( * ) Notice: Subject to any disclaimer, the term of this patent is extended or adjusted under 35 U.S.C. 154(b) by 239 days.

(21) Appl. No.: 15/408,388

(22) Filed: Jan. 17, 2017

(65) Prior Publication Data

US 2017/0213523 A1 Jul. 27, 2017

(30) Foreign Application Priority Data

Jan. 27, 2016 (TW) ..... 105102460 A

(51) Int. Cl.

| | |
|---|---|
| ***G09G 3/36*** | (2006.01) |
| ***G09G 5/10*** | (2006.01) |
| ***G09G 3/20*** | (2006.01) |
| ***G09G 3/34*** | (2006.01) |
| ***G09G 5/02*** | (2006.01) |

(52) U.S. Cl.

CPC ..... *G09G 5/10* (2013.01); *G09G 3/2003* (2013.01); *G09G 3/3406* (2013.01); *G09G 5/02* (2013.01); *G09G 2320/0233* (2013.01); *G09G 2320/064* (2013.01); *G09G 2320/066* (2013.01); *G09G 2320/0646* (2013.01); *G09G 2320/0666* (2013.01); *G09G 2320/08* (2013.01); *G09G 2360/144* (2013.01)

(58) Field of Classification Search

CPC ..... G09G 2360/14–148

See application file for complete search history.

(56) References Cited

U.S. PATENT DOCUMENTS

| | | | | |
|---|---|---|---|---|
| 2008/0018800 | A1* | 1/2008 | Kodavalla | H04N 5/202 348/672 |
| 2009/0303215 | A1* | 12/2009 | Shiozaki | G09G 3/3406 345/207 |
| 2011/0234612 | A1* | 9/2011 | Wei | G09G 3/3426 345/589 |
| 2015/0194091 | A1* | 7/2015 | Tusch | G09G 3/3291 345/690 |
| 2017/0039919 | A1* | 2/2017 | Wu | G09G 3/2003 |

FOREIGN PATENT DOCUMENTS

| | | | |
|---|---|---|---|
| CN | 101042841 | A | 9/2007 |
| CN | 103050089 | A | 4/2013 |
| CN | 104299600 | A | 1/2015 |
| CN | 105208186 | A | 12/2015 |
| CN | 103413536 | B | 3/2016 |
| TW | 201517010 | A | 5/2015 |
| TW | 201528237 | A | 7/2015 |

* cited by examiner

*Primary Examiner* — Sanghyuk Park

(57) ABSTRACT

An image adjusting method is applied to a display apparatus having an ambient light sensor. The image adjusting method includes driving the ambient light sensor to detect surrounding illumination, adjusting PWM values of a plurality of pixels on the display apparatus according to the surrounding illumination, and adjusting intensity offset values of the plurality of pixels according to an offset amending function.

21 Claims, 10 Drawing Sheets

IMAGE ADJUSTING METHOD OF IMPROVING DETAILS OF A BRIGHT SCENE AND A DARK SCENE WITHIN AN IMAGE FRAME AND RELATED DISPLAY APPARATUS

BACKGROUND OF THE INVENTION

1. Field of the Invention

The present invention relates to an image adjusting method and a related display apparatus, and more particularly, to an image adjusting method and a related display apparatus capable of improving details of a bright scene and a dark scene within an image frame.

2. Description of the Prior Art

Intensity of an image frame displayed on the display apparatus can be varied in accordance with surrounding illumination to provide particular vision experience. For instance, while the display apparatus put in a brightness environment is kept at first grade intensity, an user who watches the image frame with the first grade intensity does not feel uncomfortable, and the image frame with the first grade intensity is harsh to the user's eyes while the display apparatus kept at first grade intensity is moved to a darkness environment. For overcoming the drawback, a display apparatus having a backlight adjusting function is developed, and the display apparatus utilizes an ambient light sensor to detect the surrounding illumination and adjusts the backlight of the display apparatus accordingly. However, the conventional backlight adjusting method uses manual adjustment to vary the backlight of the image frame, details of a dark scene is difficult to distinguish from the image frame having low backlight intensity, so that the conventional backlight adjusting method cannot provide the image having stable quality.

SUMMARY OF THE INVENTION

The present invention provides an image adjusting method and a related display apparatus capable of improving details of a bright scene and a dark scene within an image frame for solving above drawbacks.

According to the claimed invention, an image adjusting method is applied to a display apparatus, and the display apparatus has an ambient light sensor. The image adjusting method includes steps of driving the ambient light sensor to detect surrounding illumination, adjusting backlight intensity of a plurality of pixels on the display apparatus according to the surrounding illumination, and adjusting intensity offset values of the plurality of pixels according to an offset amending function.

According to the claimed invention, a display apparatus includes a panel unit, an ambient light sensor and a controller. The panel unit has a plurality of pixels to display an image frame. The ambient light sensor is adapted to detect a surrounding illumination about the panel unit. The controller is electrically connected to the panel unit and the ambient light sensor. The controller is adapted to drive the ambient light sensor to detect the surrounding illumination, to adjust backlight intensity of the plurality of pixels according to the surrounding illumination, and to adjust intensity offset values of the plurality of pixels according to an offset amending function.

The image adjusting method of the present invention is applied to the display apparatus having the ambient light sensor. According to the surrounding illumination detected by the ambient light sensor, the image adjusting method can switch the display apparatus into the corresponding displaying mode; for example, the display apparatus provides high-intensity pixels while being located in the high brightness environment, and provides low-intensity pixels while being located in the low brightness environment. In the cause of prevent the image frame from overexposure or having distorted dark scene, the image adjusting method not only adjusts the PWM value of the pixel, but also utilizes the offset amending function to vary the intensity offset value of the pixel for effectively correcting details of the dark scene and preventing the image frame from flicker, so that the bright scene can be soft without harsh and the dark scene is clear without distortion.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
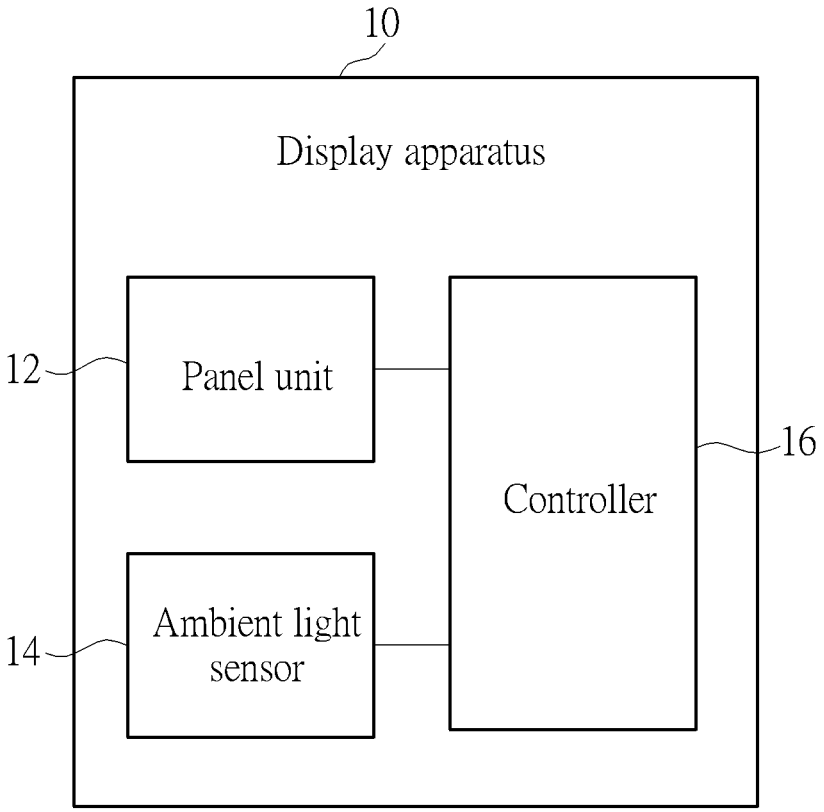
FIG. 1 is a functional block diagram of a display apparatus according to an embodiment of the present invention.

Please refer to FIG. 1. FIG. 1 is a functional block diagram of a display apparatus 10 according to an embodiment of the present invention. The display apparatus 10 includes a panel unit 12, an ambient light sensor 14 and a controller 16. The panel unit 12 has a plurality of pixels in accordance with screen resolution. The ambient light sensor 14 is disposed adjacent by the panel unit 12 and adapted to detect surrounding illumination of the panel unit 12. The controller 16 is electrically connected to the panel unit 12 and the ambient light sensor 14, and can drive the panel unit 12 to display an image frame in accordance with a control command; for example, the controller 16 can be represented as a scaler integrated circuit. The display apparatus 10 provides a plurality of displaying modes with particular parameters. Each displaying mode has corresponding parameter setting, such as a contrast value, a pulse width modulation value (PWM value), an intensity offset value and a color value, according to variation of the surrounding backlight source. The controller 16 can switch the panel unit 12 into a corresponding displaying mode in accordance with a detection result of the ambient light sensor 14, which means the parameter setting of the panel unit 12 can be automatically adjusted by variation of the surrounding illumination, so as to prevent a bright scene from overexposure and prevent a dark scene from distortion.

Figure 2:
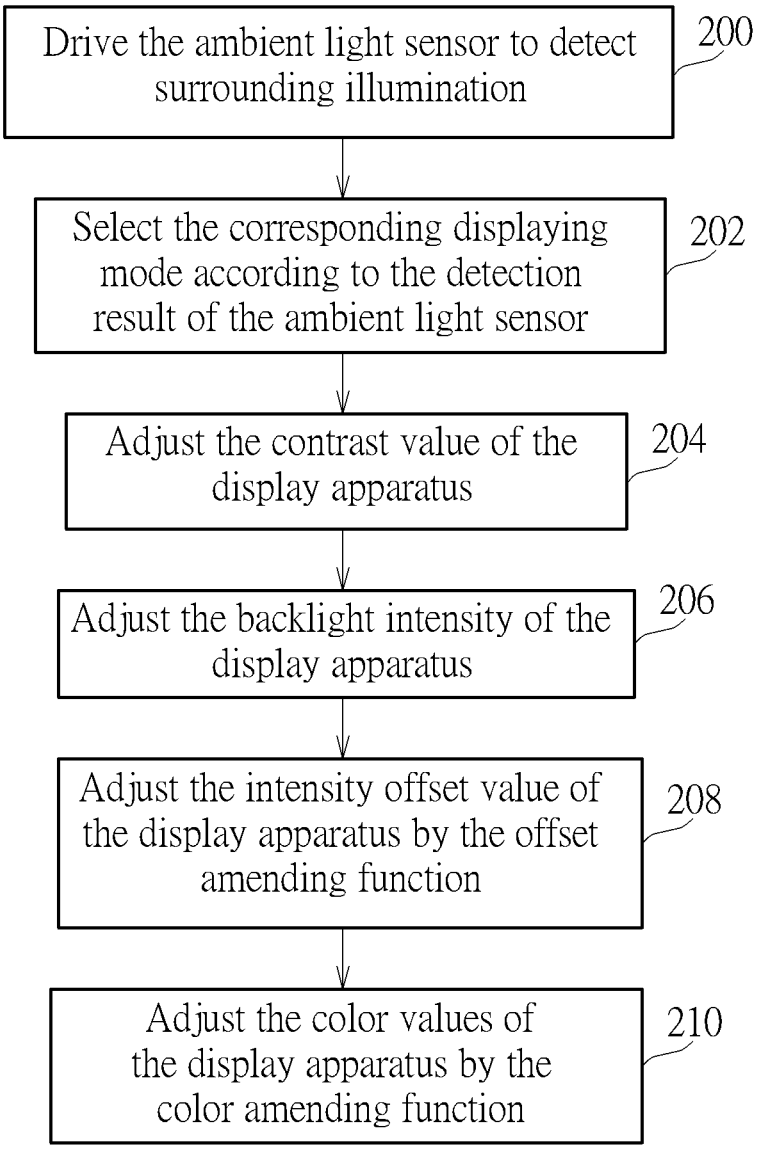
FIG. 2 is a flow chart of an image adjusting method according to the embodiment of the present invention.

Please refer to FIG. 2 to FIG. 10. FIG. 2 is a flow chart of an image adjusting method according to the embodiment of the present invention. FIG. 3 to FIG. 10 are curve diagrams of adjustment of pixels on the panel unit 12 from bright to dark according to the embodiment of the present invention. The image adjusting method illustrated in FIG. 2 is suitable for the display apparatus 10 shown in FIG. 1. First, steps 200 and 202 are executed that the controller 16 drives the ambient light sensor 14 to detect the surrounding illumination about of the display apparatus 10 and the related panel unit 12, and selects the corresponding displaying mode in accordance with the detection result of the ambient light sensor 14. In the preferred embodiment of the present invention, the display apparatus 10 provides five displaying modes, such as an office mode, a normal mode, a transition mode, a dim mode and a dark mode. Illumination of the office mode may be over than 300 lumen (lux/$m^2$), illumination of the normal mode may be ranged between 100~300 lumen, illumination of the transition mode may be ranged between 50~100 lumen, illumination of the dim mode may be ranged between 10~50 lumen, illumination of the dark mode may be lower than 10 lumen; an actual application of the foresaid displaying modes is not limited to the above-mentioned embodiment.

Then, step 202 is executed that the image adjusting method drives the ambient light sensor 14 to acquire the detective value every N seconds, collects detective values having number of M and calculates a reference value of the detective values (for example, the reference value can be, but not limited to, an average of the detective values), and the reference value is used to be a detection result of the ambient light sensor 14. Further, each displaying mode has a specific trigger condition (such like an illumination range set by the displaying mode), and the image adjusting method can compare the detection result of the ambient light sensor 14 with the trigger conditions, so as to switch the display apparatus 10 into the corresponding displaying mode.

Figure 3:
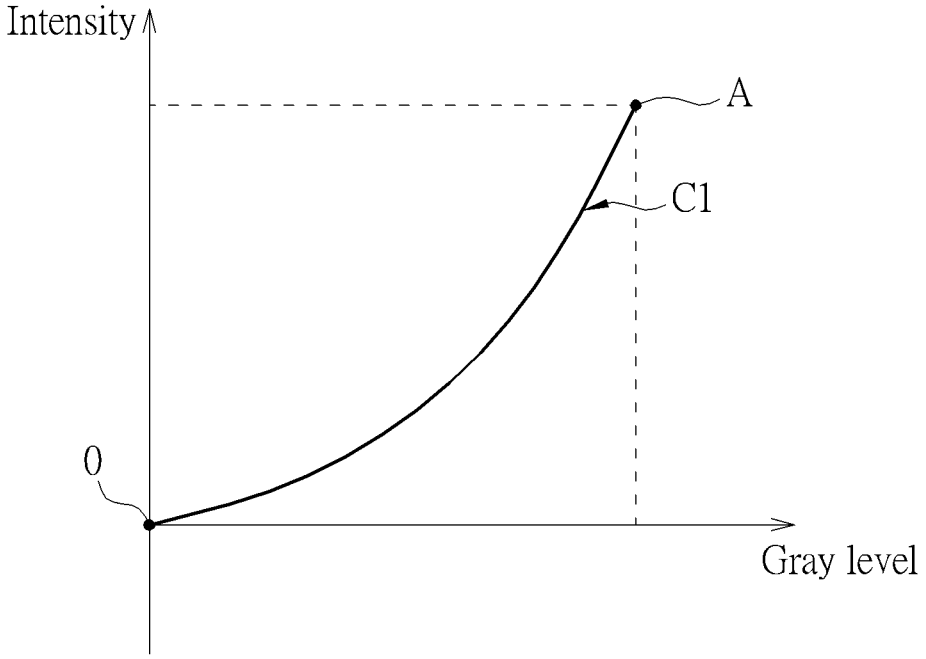
FIG. 3 to FIG. 10 are curve diagrams of adjustment of pixels on a panel unit from bright to dark according to the embodiment of the present invention.

Steps 204, 206, 208 and 210 are executed continuously. While the displaying mode is switched, the image adjusting method adjusts the contrast values of the plurality of pixels in accordance with content of the image frame (step 204), and then adjusts the backlight intensity of the plurality of pixels (step 206). The backlight intensity can be driven by, but not limited to, adjustment of the PWM values and/or DC (direct current) drives. Because integral intensity of the image frame is varied by adjustment of the PWM values, the image adjusting method further adjusts the intensity offset values of the plurality of pixels by the offset amending function (step 208), and adjusts the color values of the plurality of pixels by the color amending function (step 210) to correct distortion of the image frame. As shown in FIG. 3, the curve C1 is pixel intensity distribution without execution of the image adjusting method; while the surrounding backlight source is changed from bright to dark, the contrast value is adjusted by step 204 to raise the a curve of dark region within the pixel intensity distribution, and the curve C1 can be transformed into the curve C2 shown in FIG. 4; in the meantime, a darkest point of the pixel intensity distribution is near to zero point (or being near to 0.06 nit, which depends on actual demand). Step 204 is executed before execution of step 206 in this embodiment; however, step 204 further can be executed after step 208 or step 210, or can be cancelled without execution.

Figure 5:
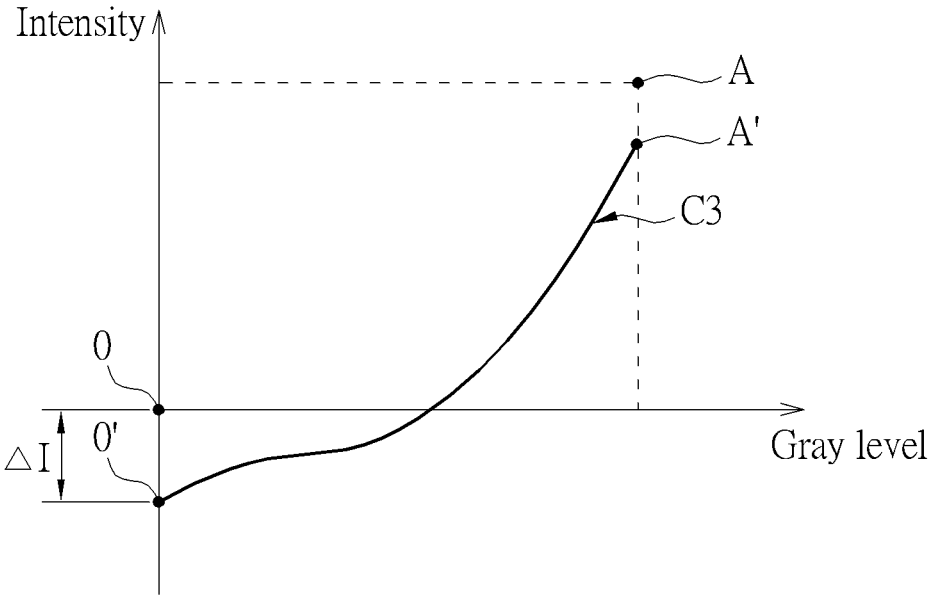
Figure 6:
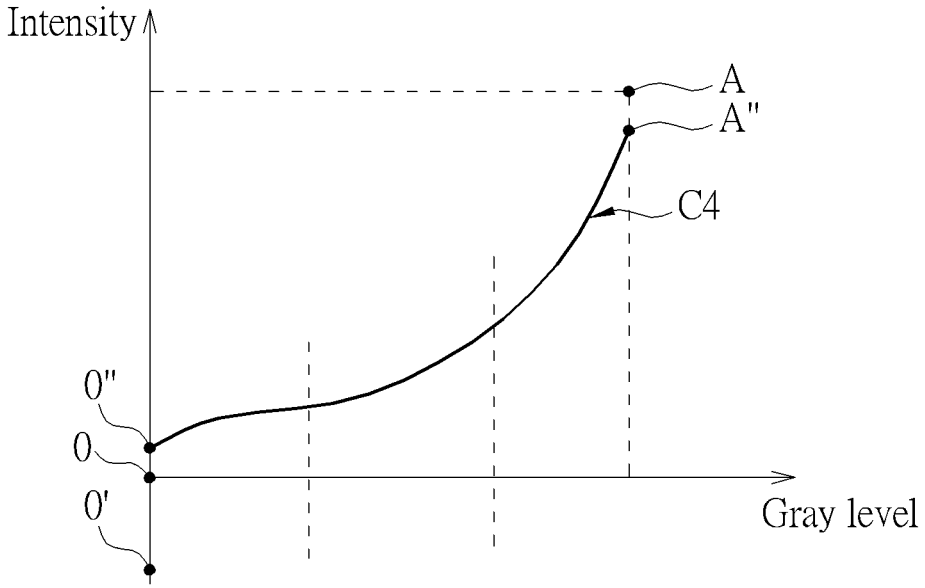

While step 206 is executed, the PWM values of the pixels is adjusted and the pixel intensity distribution is transformed from the curve C2 into the curve C3 shown in FIG. 5; the darkest point of the curve C3 is varied to position having intensity 0', the brightest point of the curve C3 is varied to position having intensity A'. Generally, the intensity of each pixel is uniformly decreased while the curve C2 is transformed into the curve C3, or the pixel intensity further can be decreased via exponential distribution, and an actual application is not limited to the above-mentioned embodiment. Details of the dark region within the image frame may be distorted in step 206, and step 208 is applied to increase the pixel intensity of the image frame, which means the offset amending function is used to increase the intensity offset value of the curve C3. In the meantime, the curve C3 is transformed into the curve C4 shown in FIG. 6, intensity of a specific pixel with lowest gray level is greater than intensity of the specific pixel unchanged by the image adjusting method; for example, the darkest point of the curve C4 is varied to position having intensity 0" (which is slightly higher than the zero point), the brightest point of the curve C4 is varied to position having intensity A" (which is slightly higher than the intensity A'), and the details of the dark region can be effectively cleared.

Figure 4:
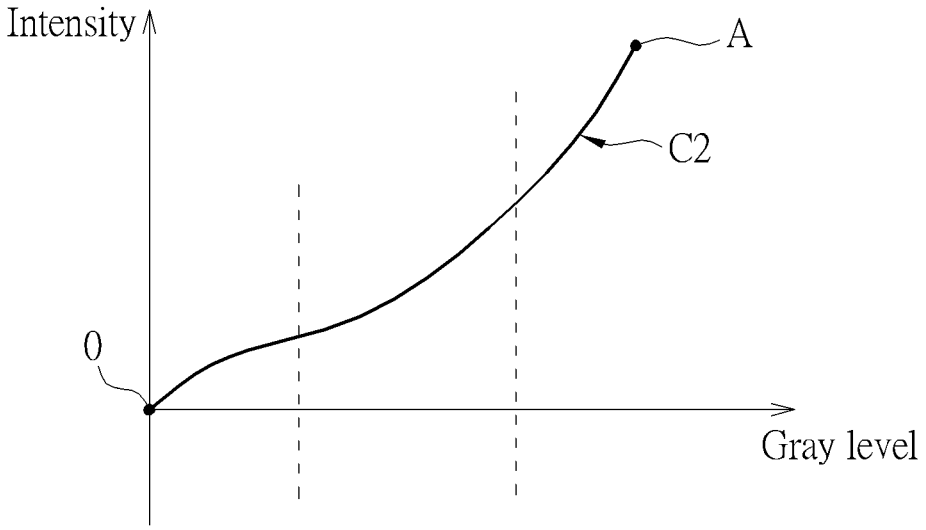

It should be mentioned that an adjustment range of the contrast value of the dark curve is preferably greater than adjustment ranges of the contrast value of the non-dark region (which means the middle curve and the bright curve) within the pixel intensity distribution while the curve C1 is transformed into the curve C2, as shown in FIG. 3 and FIG. 4. In different displaying modes, the adjustment ranges of the contrast value of the middle curve and the bright curve can be identical with each other or not according to actual demand. For example, while the surrounding backlight source is changed from bright to dark, the displaying mode particular about high contrast does not increase the middle curve, and the displaying mode particular about image details may slightly increase the middle curve; therefore the adjustment range of the contrast value can be maneuverable in accordance with properties of the displaying mode, and any adjustment mechanism capable of keeping smooth curve belongs to a scope of the present invention.

Figure 7:
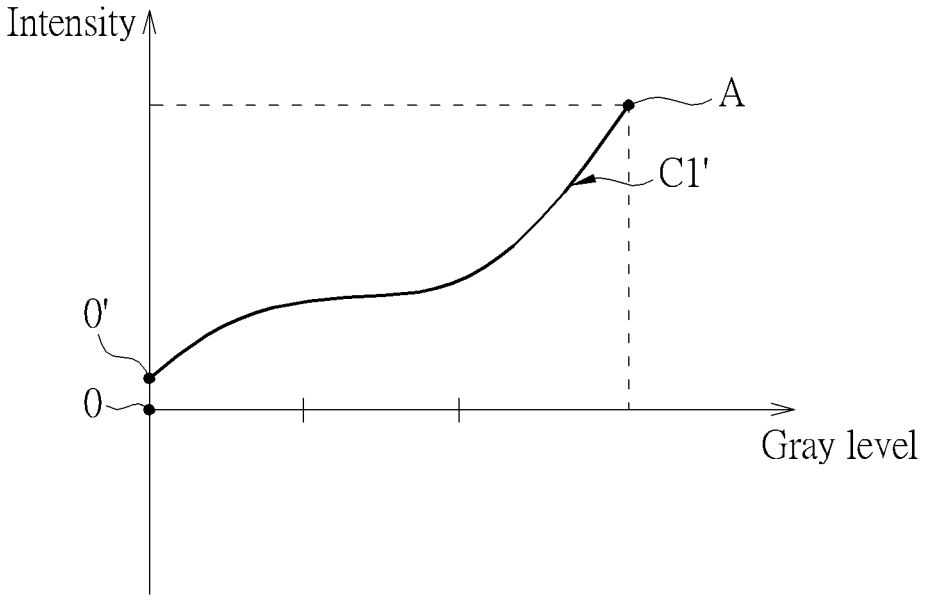
Figure 8:
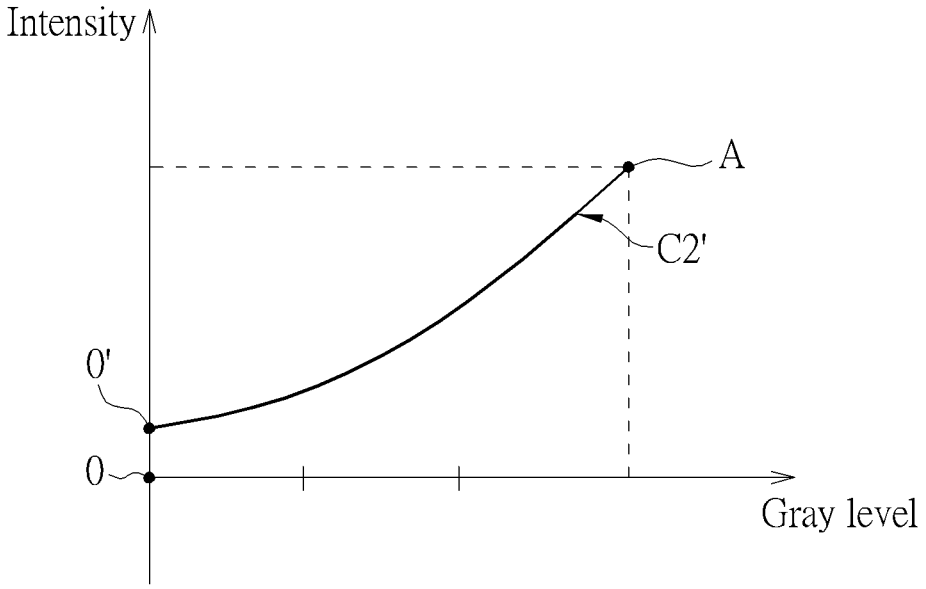

As shown in FIG. 7 to FIG. 10, while the surrounding backlight source is changed from dark to bright, the curve C1' shown in FIG. 7 is the pixel intensity distribution unchanged by the image adjusting method; while the surrounding backlight source is changed from dark to bright, step 204 is executed to adjust the contrast value for lowering the dark curve of the pixel intensity distribution, and the curve C1' is transformed into the curve C2' shown in FIG. 8. In step 206, while the surrounding illumination is increased, the image adjusting method increases the PWM values of the pixels, and the pixel intensity distribution can be transformed from the curve C2' into the curve C3' shown in FIG. 9, the darkest point of the curve C3' is varied to position having intensity 0" (which is slightly higher than the intensity 0'), and the brightest point of the curve C3' is varied to position having intensity A' (which is slightly higher than the intensity A). Then, in step 208, the image adjusting method utilizes the offset amending function to decrease the intensity offset value of the pixels, for example, the curve C3' is transformed into the curve C4' shown in FIG. 10 by the offset amending function, the intensity of the specific pixel with the lowest gray level is lower than the intensity of the specific pixel unchanged by the image adjusting method; meanwhile, the darkest point of the curve C4' is varied to position having intensity 0 (which is lower than the intensity 0' and the intensity 0"), and the brightest point of the curve C4' is varied to position having intensity A" (which is slightly lower than the intensity A' and higher than the intensity A). Generally, variation of the intensity A, A', A" are tiny and may be represented as the same point. Besides, the intensity of the specific pixel with the lowest gray level preferably can be adjusted to position having the intensity 0, and an actual situation may be a little distinct and not limited to the above-mentioned embodiment.

Figure 11A:
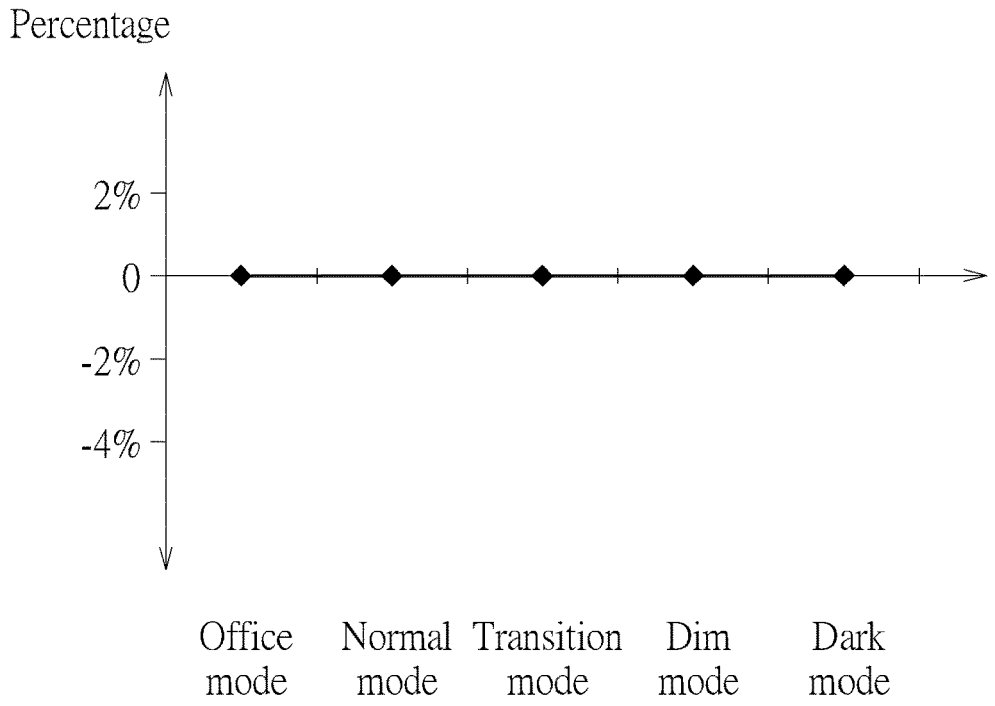
FIG. 11A, FIG. 11B and FIG. 11C respectively are curve diagrams of color value adjustment according to the embodiment of the present invention.
Figure 11B:
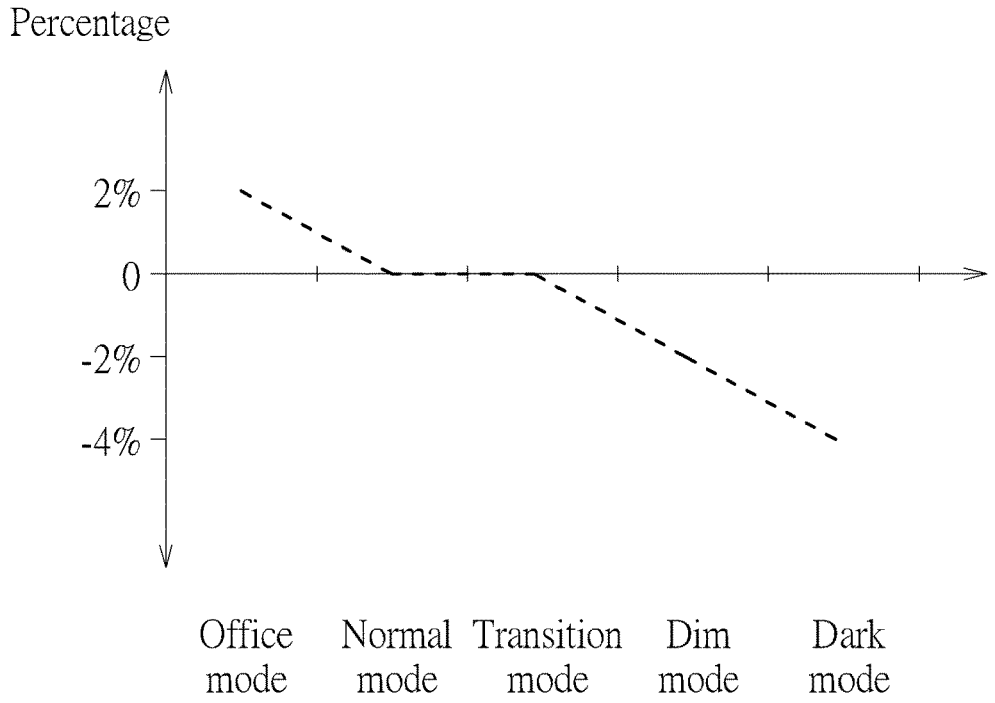
Figure 11C:
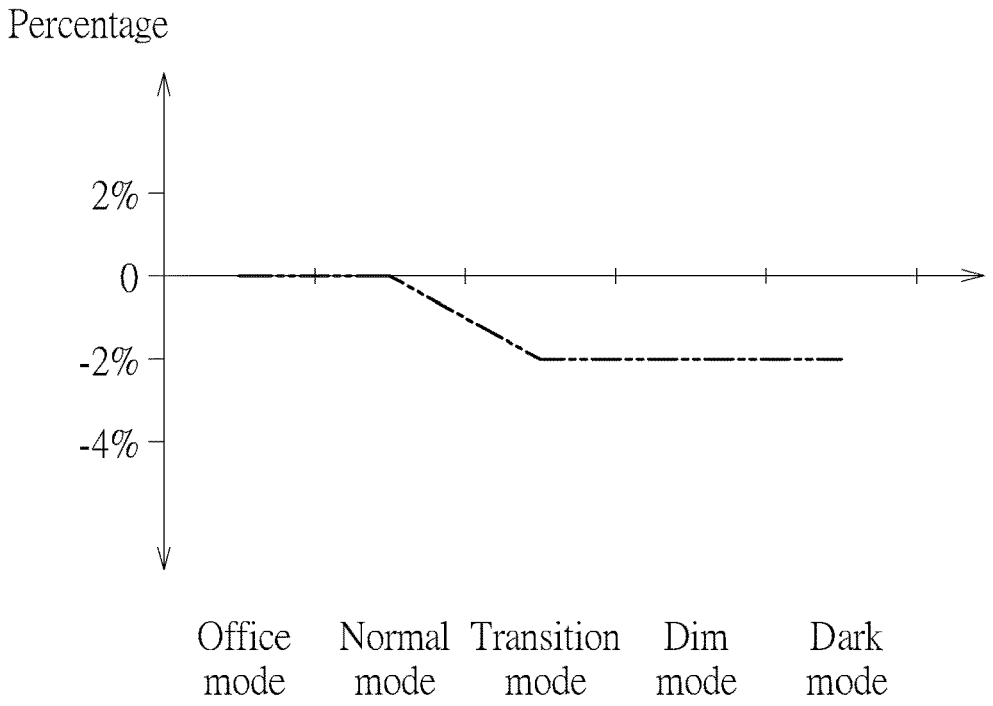

Please refer to FIG. 11A, FIG. 11B and FIG. 11C. FIG. 11A, FIG. 11B and FIG. 11C respectively are curve diagrams of color value adjustment according to the embodiment of the present invention. The color value illustrated in step 210 preferably includes, but not limit to, hue, saturation and brightness. Colors of the pixels on the panel unit 12 may be slightly distorted after adjustment of the contrast value, the PWM value and the intensity offset value, so that the image adjusting method can execute step 210 to correct the color value of the pixels. As shown in FIG. 11A, hue variation of the pixel is not obvious while switching the displaying mode, so the hue can be kept in an original value. As shown in FIG. 11B, the image adjusting method can increase the saturation of the color value while the display apparatus 10 is located in a high brightness environment (such as the office mode); the saturation is preferably unchanged and kept in the original value while the display apparatus 10 is located in a normal brightness environment (such as the normal mode); the image adjusting method may decrease the saturation while the display apparatus 10 is located in a low brightness environment (such as the dim mode and the dark mode). As shown in FIG. 11C, the brightness is preferably kept in the original value while the display apparatus 10 is located in the high brightness environment and the normal brightness environment (such as the office mode and the normal mode), and the image adjusting method further decreases the brightness for the artistic image frame while the display apparatus 10 is located in the low brightness environment (such as the dim mode and the dark mode).

Figure 12:
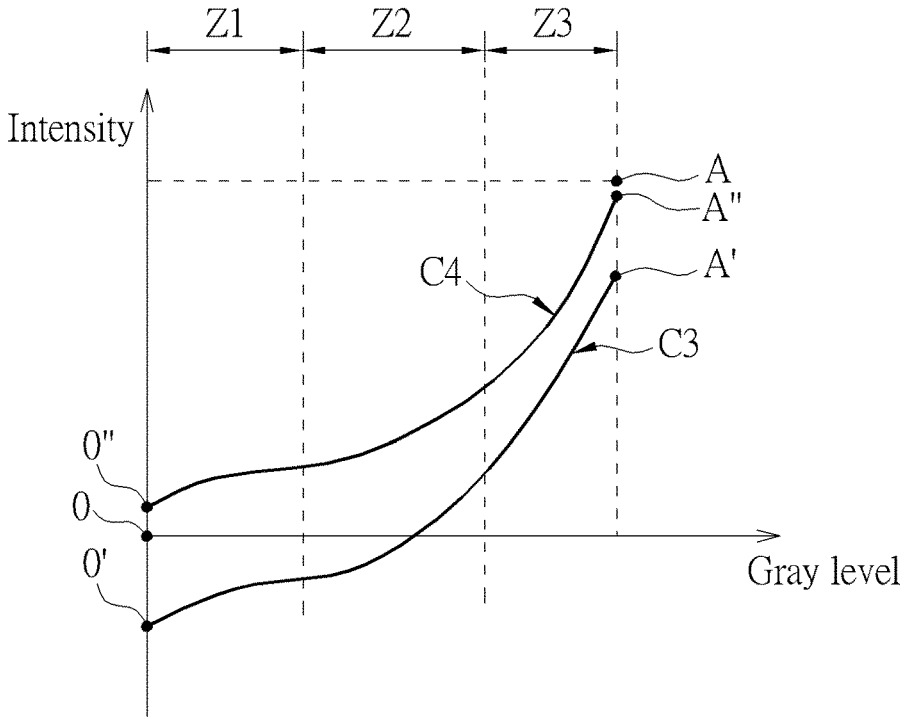
FIG. 12 is a curve diagram of adjusting the intensity offset value by a weighting parameter according to the embodiment of the present invention.
Figure 13A:
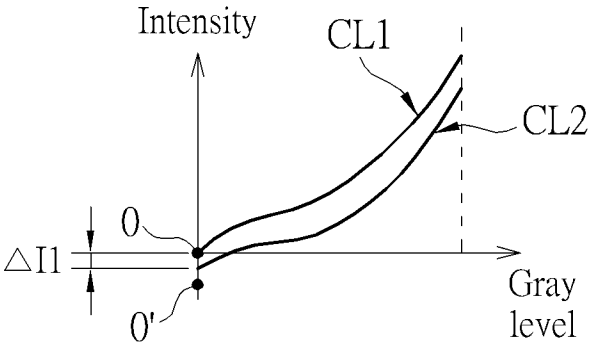
FIG. 13A, FIG. 13B, FIG. 13C and FIG. 13D respectively are diagrams of the pixel distribution curve in different adjusting procedures according to another embodiment of the present invention.
Figure 13B:
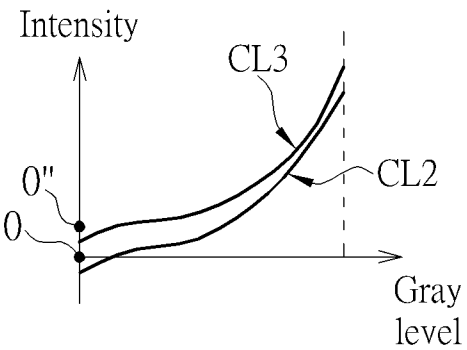
Figure 13C:
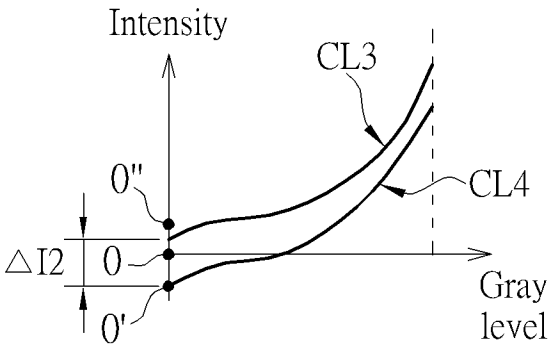
Figure 13D:
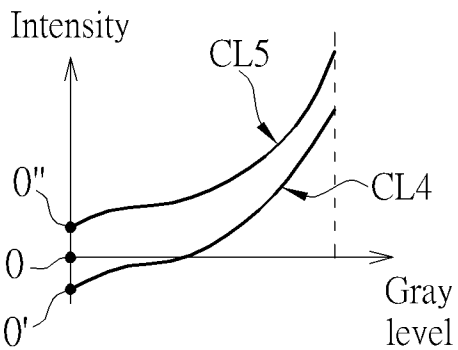

The present invention further includes an adjusting method about the intensity offset value. Please refer to FIG. 12. FIG. 12 is a curve diagram of adjusting the intensity offset value by a weighting parameter according to the embodiment of the present invention. For transforming the curve C3 into the curve C4, the image adjusting method divides the pixels into several regions in accordance with the gray level and intensity distribution of the curve, and applies weighting parameters dissimilar from each other to pixels inside different regions, so that each region can have the specific intensity offset range. For example, the first region Z1 corresponds to pixels with lower gray level, so higher weighting parameters can be applied to the first region Z1 and pixels within the first region Z1 have large intensity offset values accordingly; the third region Z3 corresponds to pixels with greater gray level, and lower weighting parameters are applied to the third region Z3 for decreasing the intensity offset range of pixels within the third region Z3; weighting parameters of the second region Z2 is set between the weighting parameters of the first region Z1 and the third region Z3, and the intensity offset range of pixels within the second region Z2 is ranged between the intensity offset ranges of the first region Z1 and the third region Z3.

The above-mentioned embodiment divides the pixels into three regions, and certainly an actual application is not limited to the foresaid embodiment; for example, the image adjusting method of the present invention can divide the gray level distribution of the curve in accordance with an amount of the pixels; which means each pixel may have own specific weighting parameter, and the image adjusting method applies the weighting parameters dissimilar from each other to the pixels with different gray levels. The pixel near to the dark point may have large weighting parameter, and the pixel near to the bright point may have lower weighting parameter.

Figure 9:
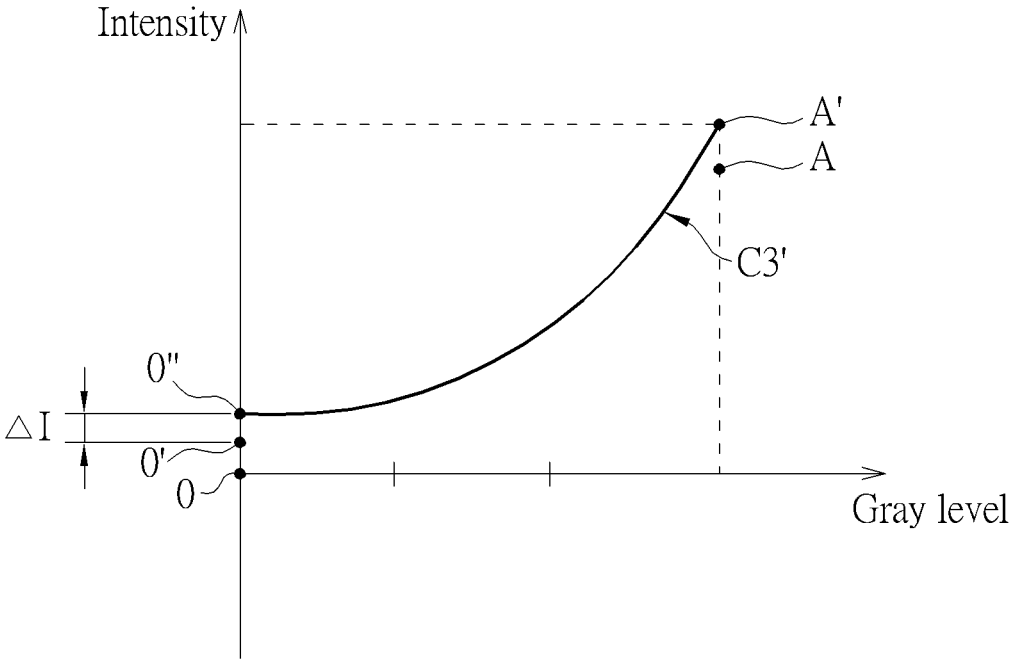
Figure 10:
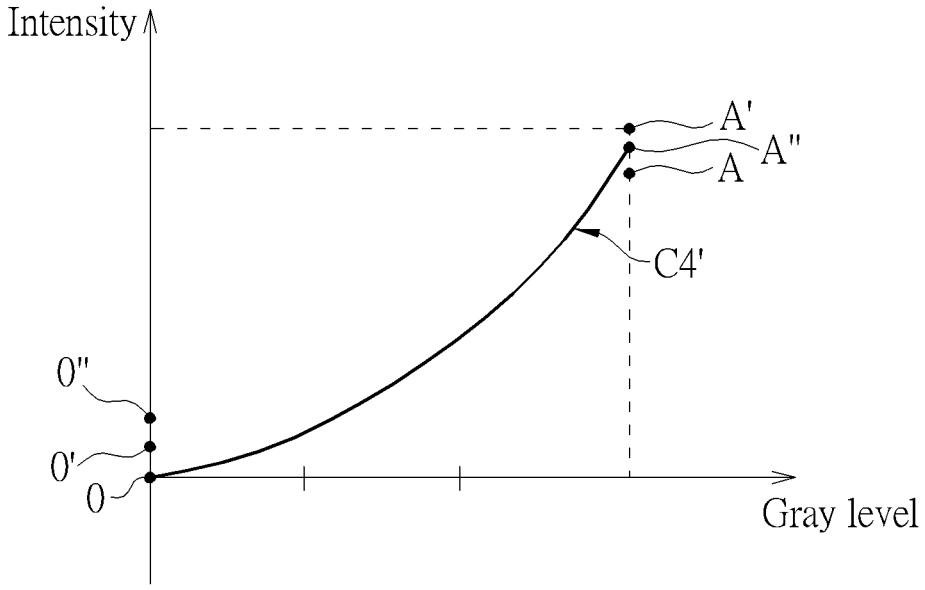

Please refer to FIG. 5, FIG. 9, FIG. 13A, FIG. 13B, FIG. 13C and FIG. 13D. FIG. 13A, FIG. 13B, FIG. 13C and FIG. 13D respectively are diagrams of the pixel distribution curve in different adjusting procedures according to another embodiment of the present invention. As shown in FIG. 5 and FIG. 9, the PWM values of the pixels are decreased to predetermines values (such like ΔI) at a time in step 206, the dark region of the pixels further utilize the offset amending function to increase the intensity offset value for approaching position having the intensity 0. As the embodiments shown in FIG. 13A, FIG. 13B, FIG. 13C and FIG. 13D, the PWM values of the pixels are separately decreased by the image adjusting method; for example, the PWM values are decreased as ΔI1 shown in FIG. 13A, the curve CL1 is transformed into the curve CL2 because decrease of the PWM value ΔI1 in step 206; then executing step 208, the intensity offset values are adjusted by the offset amending function to transform the curve CL2 into the curve CL3 shown in FIG. 13B; then executing step 206 again, the curve CL3 is transformed into the curve CL4 shown in FIG. 13C by decrease of the PWM value ΔI2; final, step 206 is executed to adjust the intensity offset values of the curve CL4 to acquire the curve CL5 shown in FIG. 13D.

In the above-mentioned embodiment, the image adjusting method divides the specific adjusting quantity ΔI of the PWM value into a plurality of sub-adjusting quantities ΔI1 and ΔI2 for respective operation, which means the sub-adjusting quantities ΔI1 and the ΔI2 are smaller than the specific adjusting quantity ΔI. The image adjusting method separately adjusts the PWM values and the intensity offset values of the pixels, multiple slight intensity variation of the pixels are generated rapidly, and the image frame has no flicker for comfortable vision experience. It should be mentioned that the specific adjusting quantity can be divided into sub-adjusting quantities with any amounts, and is not limited to the two sub-adjusting quantities of the above-mentioned embodiment.

In conclusion, the image adjusting method of the present invention is applied to the display apparatus having the ambient light sensor. According to the surrounding illumination detected by the ambient light sensor, the image adjusting method can switch the display apparatus into the corresponding displaying mode; for example, the display apparatus provides high-intensity pixels while being located in the high brightness environment, and provides low-intensity pixels while being located in the low brightness environment. In the cause of prevent the image frame from overexposure or having distorted dark scene, the image adjusting method not only adjusts the PWM value of the pixel, but also utilizes the offset amending function to vary the intensity offset value of the pixel for effectively correcting details of the dark scene and preventing the image frame from flicker, so that the bright scene can be soft without harsh and the dark scene is clear without distortion. Moreover, the image adjusting method of the present invention preferably can achieve an aim of correcting the details of the bright scene and dark scene within the image frame by merely adjusting the PWM value and the intensity offset value of the pixel; even so, the image adjusting method is able to optionally execute steps of adjusting the contrast value and the color value for the optimal image frame. The image adjusting method preferably adjusts the contrast value before adjustment of the PWM value, and certainly the PWM value can be adjusted before the adjustment of the contrast value, which depends on actual demand.

Figure 14:
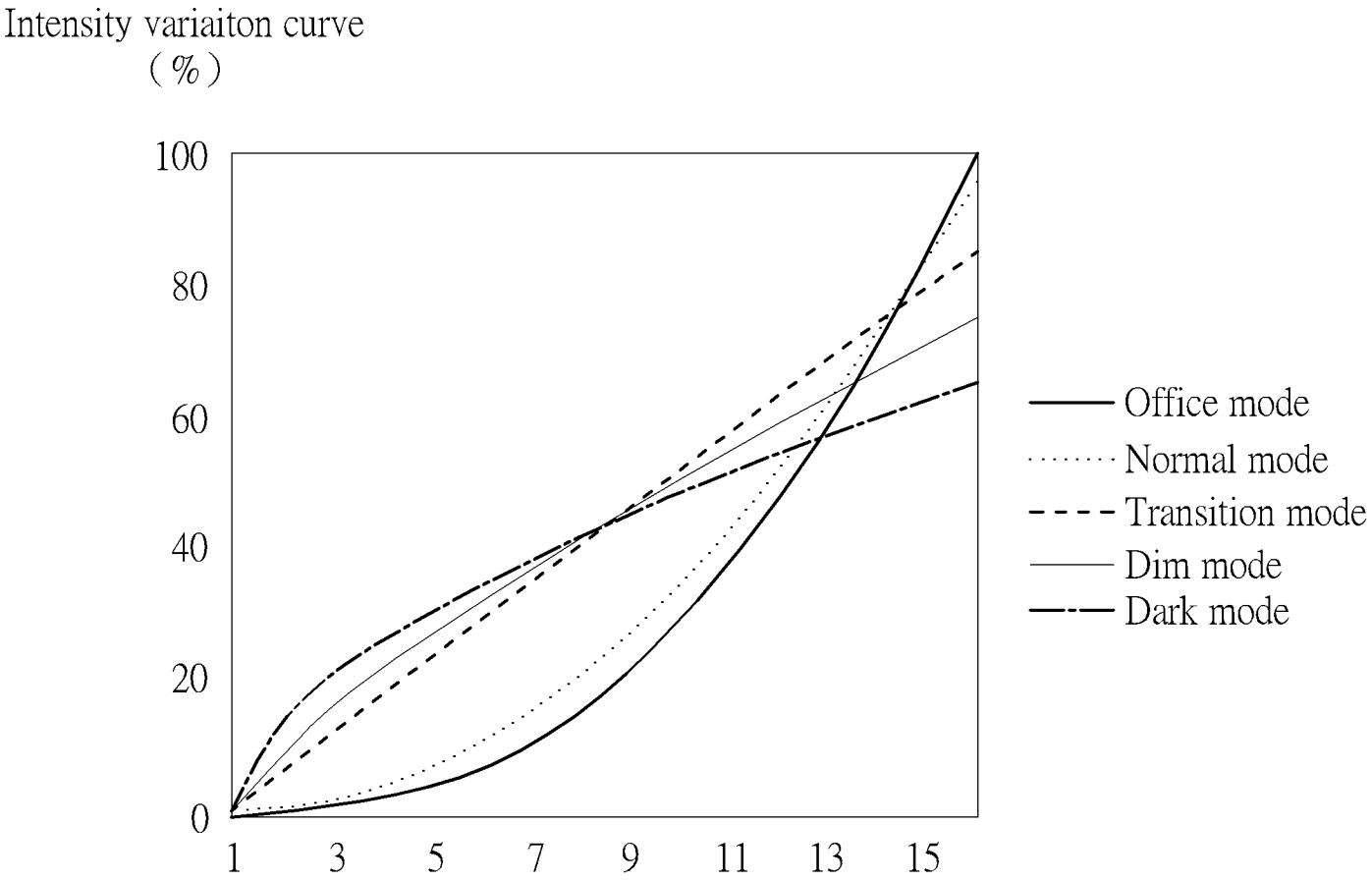
FIG. 14 is a datum diagram of the image frame displayed on the display apparatus adjusted by the image adjusting method according to the embodiment of the present invention.

Please refer to FIG. 14. FIG. 14 is a datum diagram of the image frame displayed on the display apparatus 10 adjusted by the image adjusting method according to the embodiment of the present invention. As shown in FIG. 14, the dark region of the pixels can be kept at position near to the intensity 0 no matter what displaying mode the display apparatus is switched, and then the office mode (which represents the highest brightness environment) has the bright scene with high intensity and the dark mode (which represents the lowest brightness environment) has the bright scene with low intensity. Comparing to the prior art, the display apparatus of the present invention can provide the soft image frame for comfortable observation while the surrounding illumination is violently changed.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. An image adjusting method applied to a display apparatus, the display apparatus having an ambient light sensor, the image adjusting method comprising:

driving the ambient light sensor to detect surrounding illumination;

adjusting backlight intensity of a plurality of pixels on the display apparatus according to the surrounding illumination;

decreasing PWM values of the plurality of pixels such that the pixel intensities of the darkest and brightest pixels of the plurality of pixels are decreased to be respectively less than the darkest and brightest pixels of the plurality of pixels unchanged by the image adjusting method and utilizing an offset amending function to increase the intensity offset values of the plurality of pixels such that intensity of the darkest pixel is greater than intensity of the darkest pixel unchanged by the image adjusting method and intensity of the brightest pixel is less than intensity of the brightest pixel unchanged by the image adjusting method while the surrounding illumination is decreased; and increasing PWM values of the plurality of pixels such that the pixel intensities of the darkest and brightest pixels of the plurality of pixels are increased to be respectively greater than the darkest and brightest pixels of the plurality of pixels unchanged by the image adjusting method and utilizing an offset amending function to increase the intensity offset values of the plurality of pixels such that intensity of the darkest pixel is less than intensity of the darkest pixel unchanged by the image adjusting method and intensity of the brightest pixel is greater than intensity of the brightest pixel unchanged by the image adjusting method while the surrounding illumination is increased.

2. The image adjusting method of claim 1, further comprising:

adjusting contrast values of the plurality of pixels according to content of an image frame displayed on the display apparatus.

3. The image adjusting method of claim 2, wherein the image adjusting method adjusts the contrast values of the plurality of pixels before adjustment of the PWM values of the plurality of pixels.

4. The image adjusting method of claim 1, further comprising:

adjusting color values of the plurality of pixels according to a color amending function.

5. The image adjusting method of claim 4, wherein saturation and brightness of the color values are amended by the color amending function.

6. The image adjusting method of claim 4, wherein the image adjusting method increases the saturation of the color values while the display apparatus is located in a high brightness environment, or decreases the saturation and the brightness of the color values while the display apparatus is located in a low brightness environment.

7. The image adjusting method of claim 1, wherein the image adjusting method drives the ambient light sensor to acquire a detective value every N seconds, collects detective values having number of M, and calculates a reference value of the detective values for being a detection result.

8. The image adjusting method of claim 1, wherein the display apparatus comprises a plurality of displaying modes, each displaying mode has a specific trigger condition, the image adjusting method compares a detective result of the ambient light sensor with the specific trigger condition, to switch the display apparatus into one of the plurality of displaying modes accordingly.

9. The image adjusting method of claim 1, wherein the image adjusting method applies weighting parameters dissimilar from each other to pixels with different gray levels, so as to adjust the intensity offset values of the pixels.

10. The image adjusting method of claim 1, wherein the PWM values of a corresponding displaying mode of the display apparatus has a specific adjusting quantity, the image adjusting method optionally divides the specific adjusting quantity into a plurality of sub-adjusting quantities, and utilizes the plurality of sub-adjusting quantities to respectively adjust the PWM values and the intensity offset values of the plurality of pixels.

11. The image adjusting method of claim 1, wherein a step of adjusting the intensity offset values of the plurality of pixels according to the offset amending function comprises:

adjusting intensity offset values of at least part of low-intensity pixels or at least part of high-intensity pixels from the plurality of pixels according to the offset amending function.

12. A display apparatus, comprising:

a panel unit, having a plurality of pixels to display an image frame;

an ambient light sensor adapted to detect a surrounding illumination about the panel unit; and a controller electrically connected to the panel unit and the ambient light sensor, the controller being adapted to drive the ambient light sensor to detect the surrounding illumination, to adjust backlight intensity of the plurality of pixels according to the surrounding illumination by:

decreasing PWM values of the plurality of pixels such that the pixel intensities of the darkest and brightest pixels of the plurality of pixels are decreased to be respectively less than the darkest and brightest pixels of the plurality of pixels unchanged by the image adjusting method and utilizing an offset amending function to increase the intensity offset values of the plurality of pixels such that intensity of the darkest pixel is greater than intensity of the darkest pixel unchanged by the image adjusting method and intensity of the brightest pixel is less than intensity of the brightest pixel unchanged by the image adjusting method while the surrounding illumination is decreased; and increasing PWM values of the plurality of pixels such that the pixel intensities of the darkest and brightest pixels of the plurality of pixels are increased to be respectively greater than the darkest and brightest pixels of the plurality of pixels unchanged by the image adjusting method and utilizing an offset amending function to increase the intensity offset values of the plurality of pixels such that intensity of the darkest pixel is less than intensity of the darkest pixel unchanged by the image adjusting method and intensity of the brightest pixel is greater than intensity of the brightest pixel unchanged by the image adjusting method while the surrounding illumination is increased.

13. The display apparatus of claim 12, wherein the controller further adjusts contrast values of the plurality of pixels according to content of the image frame displayed on the panel unit.

14. The display apparatus of claim 13, wherein the controller adjusts the contrast values of the plurality of pixels before adjustment of the PWM values of the plurality of pixels.

15. The display apparatus of claim 12, wherein the controller further adjusts color values of the plurality of pixels according to a color amending function.

16. The display apparatus of claim 15, wherein the saturation and brightness of the color values are amended by the color amending function, the controller increases the saturation of the color values while the display apparatus is located in a high brightness environment, or decreases the saturation and the brightness of the color values while the display apparatus is located in a low brightness environment.

17. The display apparatus of claim 12, wherein the controller drives the ambient light sensor to acquire a detective value every N seconds, collects detective values having number of M, and calculates a reference value of the detective values for being a detection result.

18. The display apparatus of claim 12, wherein the display apparatus comprises a plurality of displaying modes, each displaying mode has a specific trigger condition, the controller compares a detective result of the ambient light sensor with the specific trigger condition, to switch the display apparatus into one of the plurality of displaying modes accordingly.

19. The display apparatus of claim 12, wherein the controller applies weighting parameters dissimilar from each other to pixels with different gray levels, so as to adjust the intensity offset values of the pixels.

20. The display apparatus of claim 12, wherein the PWM value of a corresponding displaying mode of the display apparatus has a specific adjusting quantity, the controller optionally divides the specific adjusting quantity into a plurality of sub-adjusting quantities, and utilizes the plurality of sub-adjusting quantities to respectively adjust the PWM values and the intensity offset values of the plurality of pixels.

21. The display apparatus of claim 12, wherein the controller is further adapted to adjust intensity offset values of at least part of low-intensity pixels or at least part of high-intensity pixels from the plurality of pixels according to the offset amending function.

* * * * *